US010109918B2

(12) United States Patent
Thill

(10) Patent No.: US 10,109,918 B2
(45) Date of Patent: Oct. 23, 2018

(54) MULTI-ELEMENT ANTENNA FOR MULTIPLE BANDS OF OPERATION AND METHOD THEREFOR

(71) Applicant: Airgain, Inc., San Diego, CA (US)

(72) Inventor: Kevin Thill, Scottsdale, AZ (US)

(73) Assignee: Airgain Incorporated, San Diego, CA (US)

( * ) Notice: Subject to any disclaimer, the term of this patent is extended or adjusted under 35 U.S.C. 154(b) by 327 days.

(21) Appl. No.: 15/004,631

(22) Filed: Jan. 22, 2016

(65) Prior Publication Data

US 2017/0214140 A1 Jul. 27, 2017

(51) Int. Cl.

| | |
|---|---|
| ***H01Q 9/04*** | (2006.01) |
| ***H01Q 5/357*** | (2015.01) |
| ***H01Q 1/24*** | (2006.01) |
| ***H01Q 21/30*** | (2006.01) |
| ***H01Q 9/26*** | (2006.01) |
| ***H01Q 5/371*** | (2015.01) |
| ***H01Q 1/38*** | (2006.01) |
| ***H01Q 9/28*** | (2006.01) |

(52) U.S. Cl.

CPC ..... *H01Q 5/357* (2015.01); *H01Q 1/243* (2013.01); *H01Q 1/38* (2013.01); *H01Q 5/371* (2015.01); *H01Q 9/04* (2013.01); *H01Q 9/26* (2013.01); *H01Q 9/28* (2013.01); *H01Q 21/30* (2013.01)

(58) Field of Classification Search

CPC .. H01Q 9/04; H01Q 9/26; H01Q 9/28; H01Q 1/243; H01Q 1/38; H01Q 5/357; H01Q 5/371; H01Q 21/30

USPC ..... 343/700

See application file for complete search history.

(56) References Cited

U.S. PATENT DOCUMENTS

| | | | | |
|---|---|---|---|---|
| 4,205,317 A * | 5/1980 | Young | H01Q 9/065 | 343/720 |
| 5,121,127 A * | 6/1992 | Toriyama | H01Q 9/0414 | 343/700 MS |
| 5,534,877 A | 7/1996 | Sorbello et al. | | |
| 6,037,911 A * | 3/2000 | Brankovic | H01Q 1/38 | 343/700 MS |
| 6,195,048 B1 * | 2/2001 | Chiba | H01Q 1/243 | 343/700 MS |

(Continued)

FOREIGN PATENT DOCUMENTS

| | | |
|---|---|---|
| CN | 104733857 | 6/2015 |

OTHER PUBLICATIONS

A Dual-Band High-Gain Resonant Cavity Antenna With Orthogonal Polarizations by: Hamid Moghadas, Mojgan Daneshmand and Pedram Mousavi Source: IEEE Antennas and Wireless Propagation Letters, vol. 10, 2011 publication Date:2011 DOI: 10.1109/LAWP.2011.2173454.

(Continued)

*Primary Examiner* — Dameon E Levi
*Assistant Examiner* — Ab Salam Alkassim, Jr.
(74) *Attorney, Agent, or Firm* — Clause Eight IPS; Michael Catania

(57) ABSTRACT

An antenna assembly has a conductive line coupled to a feed point. An element is configured to resonate at a predetermined frequency. The element is electrically coupled to the conductive line and aligned perpendicular to the conductive line wherein the predetermined frequency of the element determines a distance from the feed point along the conductive line.

9 Claims, 2 Drawing Sheets

(56) References Cited

U.S. PATENT DOCUMENTS 6,359,596 B1 * 3/2002 Claiborne ..... H01Q 1/38 343/795
6,670,922 B1 * 12/2003 Huang ..... H01Q 1/36 343/700 MS
6,717,551 B1 4/2004 Desclos et al.
6,741,210 B2 5/2004 Brachat et al.
6,828,947 B2 * 12/2004 Apostolos ..... H01Q 7/00 343/895
6,891,504 B2 5/2005 Cheng et al.
6,906,678 B2 * 6/2005 Chen ..... H01Q 1/243 343/700 MS
7,042,412 B2 * 5/2006 Chuang ..... H01Q 9/26 343/795
7,193,562 B2 * 3/2007 Shtrom ..... H01Q 1/38 343/700 MS
7,362,280 B2 * 4/2008 Shtrom ..... H01Q 3/24 343/795
7,626,555 B2 * 12/2009 Kalliokoski ..... H01Q 9/0471 343/702
7,884,775 B1 * 2/2011 Loyet ..... H01Q 1/38 343/795
8,031,129 B2 * 10/2011 Shtrom ..... H01Q 3/24 343/853
8,059,049 B2 11/2011 Quan et al.
8,866,689 B2 * 10/2014 Islam ..... H01Q 21/30 343/700 MS
8,988,308 B2 3/2015 Jidhage et al.
9,287,633 B2 * 3/2016 Tseng ..... H01Q 21/26
9,831,554 B2 * 11/2017 Tsai ..... H01Q 5/371
9,947,999 B2 * 4/2018 Tsai ..... H01Q 1/38
2004/0001023 A1 * 1/2004 Peng ..... H01Q 1/38 343/725
2005/0035919 A1 * 2/2005 Yang ..... H01Q 1/38 343/795
2007/0046548 A1 * 3/2007 Pros ..... H01Q 1/243 343/702
2008/0074340 A1 * 3/2008 Song ..... H01Q 1/38 343/816
2009/0128414 A1 * 5/2009 Jeng, Jr. ..... H01Q 9/26 343/700 MS
2010/0085268 A1 * 4/2010 Yeh ..... H01Q 7/00 343/803
2010/0117907 A1 * 5/2010 Su ..... H01Q 1/243 343/700 MS
2012/0249386 A1 * 10/2012 Yanagi ..... H01Q 1/24 343/749
2013/0009836 A1 * 1/2013 Islam ..... H01Q 1/241 343/810
2013/0017786 A1 1/2013 Kvist et al.
2013/0135153 A1 5/2013 Wang et al.
2013/0234896 A1 * 9/2013 Sharawi ..... H01Q 9/0421 343/700 MS
2014/0132469 A1 * 5/2014 Wang ..... H01Q 1/2266 343/821
2014/0242903 A1 8/2014 DeLuis et al.
2015/0372383 A1 * 12/2015 Yoshida ..... H01Q 1/2291 343/853
2016/0020521 A1 * 1/2016 Astakhov ..... H01Q 1/48 343/769
2017/0250459 A1 * 8/2017 Kashiwagi ..... H01Q 7/00

OTHER PUBLICATIONS

Design and Analysis of Dual-Band Inverted-F Antenna With Orthogonal Frequency-Controlled Radiation Planes by: Loizou, Loizos; Buckley, John: O'Flynn, Brendan Source: IEEE Transactions on Antennas and Propagation 61.8 (2013): 3946-3951 Publication Date: 2013 DOI:10.1109/TAP.2013.2260316.

A Novel Dual-Band Printed Diversity Antenna for Mobile Terminals by: Ding Yuan; Tsinghua Univ., Beijing; Zhengwei Du; Ke Gong; Zhenghe Feng Source: Antennas and Propagation, IEEE Transactions on (vol. 55, Issue: 7) Publication Date: Jul. 2007 DOI: 10.1109/TAP.2007.900249.

Compact Dual-Polarization Antenna for a Mobile Device IP.com Disclosure No. IPCOM000174237D Publication Date Sep. 3, 2008.

* cited by examiner

MULTI-ELEMENT ANTENNA FOR MULTIPLE BANDS OF OPERATION AND METHOD THEREFOR

TECHNICAL FIELD

The present application generally relates to antennas, and more specifically to a multi-element antenna in which each element is orthogonal to a conductive line being fed by a transmission line to provide for multiple working frequencies.

BACKGROUND

More and more electronic devices are being designed with wireless communication capabilities. These devices, such as portable computers, smartphones, tablets, smart watches and other handheld electronic may be provided with long-range wireless communications circuitry such as cellular telephone circuitry and/or short-range communications circuitry such as wireless local area network communications circuitry. Some of the aforementioned devices may be provided with the ability to receive other wireless signals such as Global Positioning System (GPS) signals.

Antenna design may be difficult since the antenna has to satisfy a plurality of different requirements related to geometry, electrical performance, efficiency as well as other requirements. For example, with electronic devices becoming smaller in size, the space available for the antennas may be limited. In many electronic devices, the presence of electronic components of the electronic device may be a source of electromagnetic interference for the antenna. Antenna operation may also be disrupted by nearby conductive structures. Considerations such as these can make it difficult to implement an antenna in an electronic device.

These issues maybe compounded in applications where the antenna may need to operate in multiple bands. For example, cellular telephone networks and WIFI Internet connections are commonly used for communication with portable electronic devices. Cellular telephones transmit in the 824 to 845 MHz frequency band and receive signals in the 870 to 896 MHz frequency band. PCS telephones operate in the 1850 to 1990 MHz. frequency band. The WIFI protocol enables communication over different frequency bands, for example the 2.4 GHz ISM band and the 5.0 GHz U-NII band. An antenna that is tuned to operate with one of these frequency bands is not optimum for communication in another frequency band.

Therefore, it would be desirable to provide a system and method that overcomes the above.

SUMMARY

In accordance with one embodiment, an antenna assembly is disclosed. The antenna assembly has a conductive line coupled to a feed point. An element is configured to resonate at a predetermined frequency. The element is electrically coupled to the conductive line and aligned perpendicular to the conductive line wherein the predetermined frequency of the element determines a distance from the feed point along the conductive line.

In accordance with one embodiment, an antenna assembly is disclosed. The antenna assembly has a first substrate. An opening is formed in a central area of the first substrate. A first conductive line is formed on a first surface of the first substrate and runs down a length of the first substrate. A transmission line is positioned through the opening and is electrically coupled to the first conductive line. A first plurality of pairs of elements is provided. Each pair of the first plurality of pairs of elements resonates at different predetermined frequencies in a first frequency bandwidth. Each of the first plurality of pairs of elements has a first member and a corresponding member, wherein each of the first plurality of pairs of elements is electrically coupled to the first conductive line and aligned perpendicular to the first conductive line. The first member of each the first plurality of pairs of elements is positioned on a first side of the feed point along the length of the first substrate and the corresponding member of each of the first plurality of pairs of elements is positioned on an opposing side of the feed point along the length of the first substrate, the different predetermined frequencies determining a distance from the feed point along the first conductive line for each of the first plurality of pairs elements.

In accordance with one embodiment, an antenna assembly is disclosed. The antenna assembly has a first substrate. An opening is formed in a central area of the first substrate. A first conductive line is formed on a first surface of the first substrate and runs down a length of the first substrate. A transmission line is positioned through the opening and electrically coupled to the first conductive line. A first plurality of pairs of elements is provided, each pair of the first plurality of pairs of elements resonating at different predetermined frequencies in a first frequency bandwidth. Each of the first plurality of pairs of elements has a first member and a corresponding member, wherein each of the first plurality of pairs of elements is electrically coupled to the first conductive line and aligned perpendicular to the first conductive line. The first member of each of the first plurality of pairs of elements is positioned on a first side of the feed point along the length of the first substrate and the corresponding member of each of the first plurality of pairs of elements is positioned on an opposing side of the feed point along the length of the first substrate. The different predetermined frequencies determine a distance from the feed point along the first conductive line for each of the first plurality of pairs of elements. A second substrate is positioned perpendicular to the first substrate and runs down the length of the first substrate. The first plurality of pairs of elements is attached to the second substrate.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
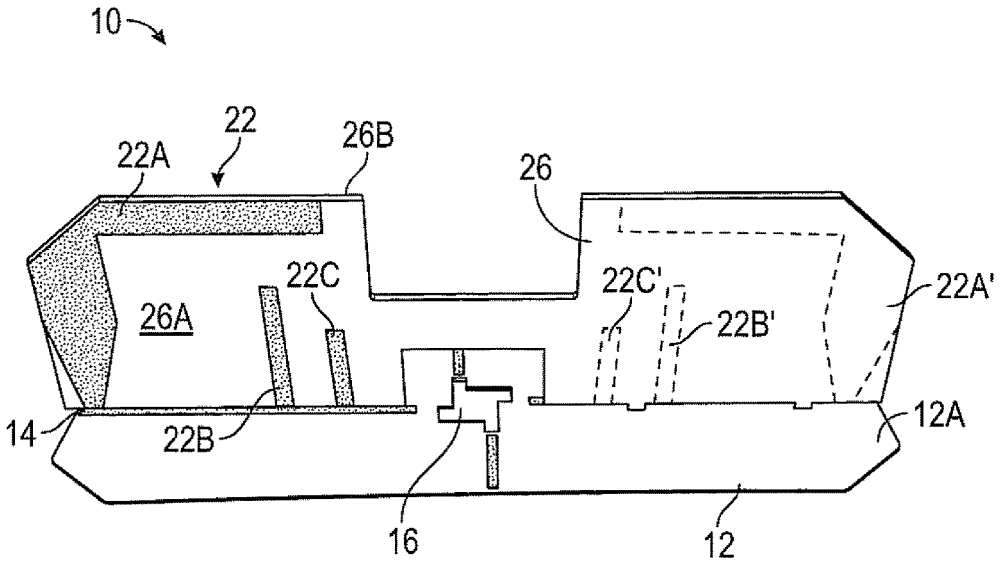
FIG. 1 is a prospective view of an antenna assembly in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure Referring to FIGS. 1 and 2, an antenna assembly 10 according with one aspect of the present invention is shown. The antenna assembly 10 may be used for bidirectional and/or unidirectional communications. The antenna assembly 10 may be formed of a substrate 12. The substrate 12 may be formed of a non-conductive material such as, but not limited to a phenolic plastic impregnated type of paper, fiberglass mats in an epoxy, Teflon/plastic sheet or similar material. One or more conductive lines 14 may be formed on a first surface 12A of the substrate 12. In the present embodiment, two conductive lines 14A and 14B may be seen. However, this is shown as an example and should not be seen in a limiting manner. The conductive lines 14 may be formed of metals such as copper, brass or the like applied on the surface 12A. In accordance with one embodiment, the conductive lines 14 may be a microstrip. The conductive lines 14 may be configured to provide an impedance at a desired level as will be disclosed below.

An opening 16 may be formed through the substrate 12. The opening 16 may be used to electrically couple a first end of a coaxial cable 18 to the conductive lines 14. A second end of the coaxial cable 18 may be coupled to a communication circuit such as a receiver and/or transceiver. A coaxial cable 18 may be coupled to each of the conductive lines 14. Thus, in the present embodiment, a coaxial cable 18A may be coupled to the conductive lines 14A and a coaxial cable 18B may be coupled to the conductive lines 14B. A coupling 20 may be used to electrically couple the coaxial cables 18 to the conductive lines 14.

As stated above, the conductive lines 14 may be configured to provide a desired impedance. The desired impedance may be based on an impedance level of the coaxial cable 18. In accordance with one embodiment, a line width of the conductive line 14 may be designed to provide an impedance level approximately equal to the coaxial cable 18 coupled to the conductive line 14. Thus, for example, the conductive line 14 may be configured to provide an impedance of 50Ω to approximately match the impedance of coaxial cable for RE applications.

One or more antenna elements 22 may be electrically coupled to the conductive lines 14. Each element 22 may be aligned perpendicular to the conductive line 14. Each element 22 may be size to resonate at a desired predetermine frequency. By providing a plurality of elements 22, the antenna assembly 10 may operate at multiple frequencies.

Each of the elements 22 may require proper placement along the conductive line 14. Impedance issues may arise if the elements 22 are not properly positioned along the conductive line 14. There is a correlation between the location of the element 22 on the conductive line 14 and wavelength. The position and length of the elements 22 may be dependent on the dielectric material of the substrate 12, the frequency the element 22 resonates at, and the like.

The elements 22 may be positioned in a descending order from a feed point 20A of the conductive line 14 on which the element 22 is located. Thus, elements 22 resonating at a higher frequency may be positioned on the conductive line 14 closer to the feed point 20A than an element 22 resonating at a lower frequency. Thus, if multiple elements 22 are placed on the conductive line 14, the element 22 resonating at the lowest frequency may be positioned furthest from the feed point 20A, while the element resonating at the highest frequency may be positioned closest to the feed point 20A. Again, the exact location of each element 22 on the conductive line 14 may vary based on the above factors.

Figure 2:
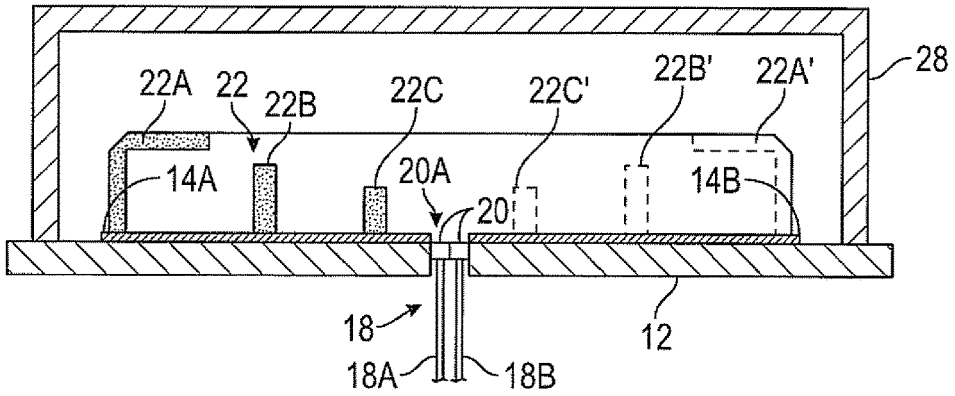
FIG. 2 is a cross-sectional view of the antenna assembly of FIG. 1 in accordance with one aspect of the present application.

For example, in FIGS. 1-2, three pairs of elements 22 may be seen wherein the first pair may be comprised of elements 22A and 22A', the second pair may be comprised of elements 22B and 22B' and the third pair may be comprised of elements 22C and 22C'. The elements 22A, 22B and 22C may be positioned on the conductive line 14A while the corresponding elements 22A', 22B' and 22C' may be positioned on the conductive line 14B. In this example, the elements 22A and 22A' may resonate at a frequency of 800 MHz, the elements 22B and 22B' may resonate at a frequency of 1600 MHz and the elements 22C and 22C' may resonate at a frequency 2400 MHz. Since the elements 22A and 22A' resonate at the lowest frequency, the elements 22A and 22A' may be located furthest from the feed point 22A. If the conductive lines 14A and 14B are approximately the same length, the elements 22A and 22A' may be located approximately equal distance from the feed point 22A. The elements 22C and 22C' resonates at the highest frequency, which is approximately three times the frequency of the elements 22A and 22A', may be positioned closest to the feed point 20A. If the conductive lines 14A and 14B are approximately the same length, the elements 22B and 22B' may be located approximately equal distance from the feed point 22A. The elements 22B and 22B', which resonates at two times the frequency of the elements 22A and 22A', may be located in the middle such that element 22B may be positioned in between the elements 22A and 22C and element 22B' may be positioned in between the elements 22A' and 22C'. If the conductive lines 14A and 14B are approximately the same length, the elements 22C and 22C' may be located approximately equal distance from the feed point 22A.

In accordance with one embodiment, the elements 22 may be planer elements instead of lumped elements. The planer elements may be microstrips 24. The microstrips 24 may be placed on a substrate 26. The substrate 26 may be coupled to the substrate 12 to electrically couple the microstrips 24 to the conductive line 14 and to keep the microstrips 24 approximately orthogonal to the conductive line 14. As may be seen in FIGS. 1-2, the elements 22A, 22B and 22C may be positioned on a first side 26A of the substrate 26 and attached to the conductive line 14A while the corresponding elements 22A', 22B' and 22C' may be positioned on a second side 26B of the substrate 26 and attached to the conductive line 14B.

A cover 28 may be positioned over the elements 22 and attached to the substrate 12. The cover 28 may be used to prevent damage to the elements 22.

Figure 3:
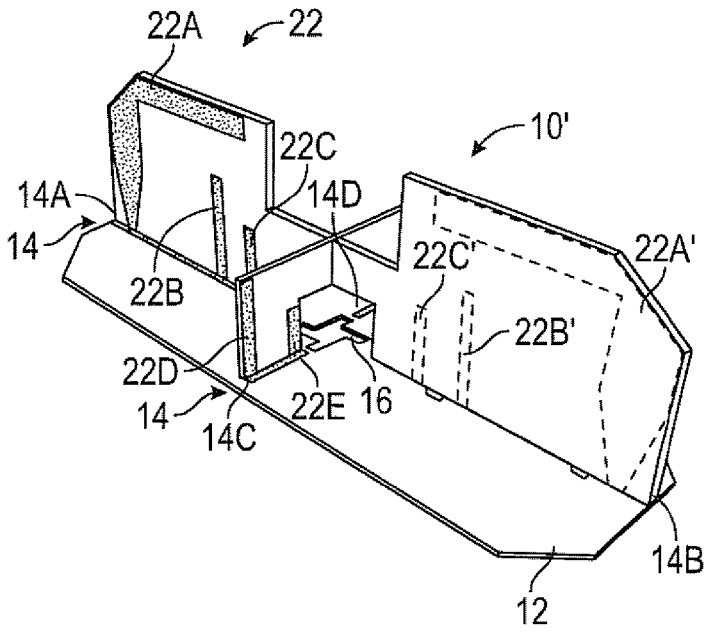
FIG. 3 is a prospective view of an antenna assembly in accordance with one aspect of the present application.
Figure 4:
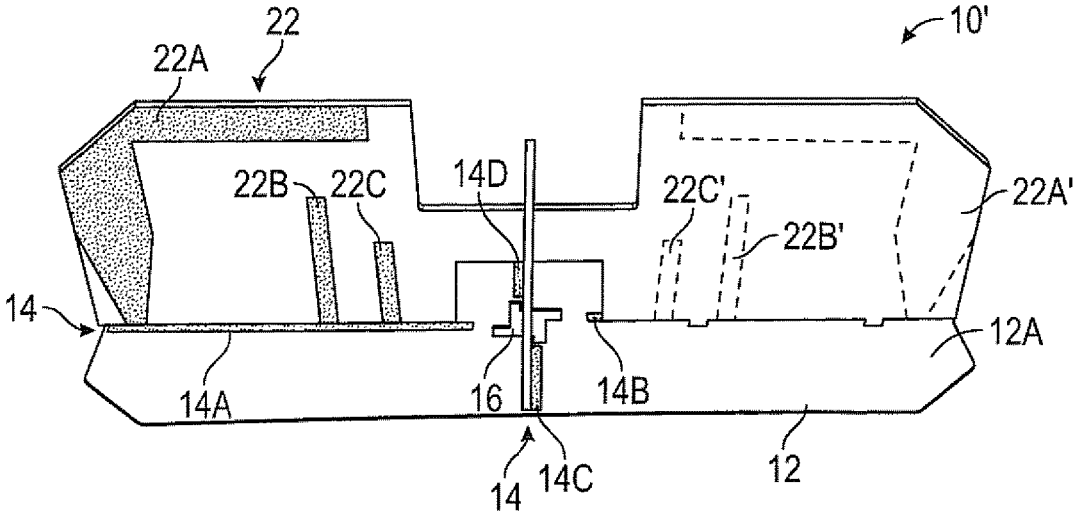
FIG. 4 is a side view of the antenna system of FIG. 4 in accordance with one aspect of the present application.

Referring to FIGS. 3-4, an antenna assembly 10' according with one aspect of the present invention is shown. The antenna assembly 10' may be used for bidirectional and/or unidirectional communications. In the present embodiment, the antenna assembly 10' may be a dual band antenna assembly. Thus, the antenna assembly 10' may allow communication in multiple frequency bands such as WiFi and cellular or other combinations of frequency bands. The above is given as an example and should not be seen in a limiting manner. Other frequency bands may be used without departing from the spirit and scope of the present invention.

The antenna assembly 10' may be formed of a substrate 12. The substrate 12 may be formed of a non-conductive material such as, but not limited to a phenolic plastic impregnated type of paper, fiberglass mats in an epoxy, Teflon/plastic sheet or similar material. One or more conductive lines 14 may be formed on a surface 12A of the substrate 12. In the present embodiment, four conductive lines 14A-14D may be seen. However, this is shown as an example and should not be seen in a limiting manner. The conductive lines 14 may be formed of metals such as copper, brass or the like applied on the surface 12A. In accordance with one embodiment, the conductive lines 14 may be a microstrip. The conductive lines 14 may be configured to provide an impedance at a desired level as will be disclosed below.

An opening 16 may be formed through the substrate 12. The opening 16 may be used to electrically couple a first end of a coaxial cable 18 (FIG. 2) to the conductive lines 14. A second end of the coaxial cable 18 may be coupled to a communication circuit such as a receiver/transceiver. As in the previous embodiment, a different coaxial cable 18 may be coupled to each of different conductive lines 14. Thus, in the present embodiment, different coaxial cables 18 may be coupled to each of the conductive lines 14A-14D. In accordance with one embodiment, a coupling 20 (FIG. 2) may be used to electrically couple the coaxial cable 18 to the conductive lines 14.

As stated above, the conductive lines 14 may be configured to provide a desired impedance. The desired impedance may be based on an impedance level of the coaxial cable 18. In accordance with one embodiment, a line width of the conductive line 14 may be designed to provide an impedance level approximately equal to the coaxial cable 18 coupled to the conductive line 14. Thus, for example, the conductive line 14 may be configured to provide an impedance of 50Ω to approximately match the impedance of coaxial cable for RF applications.

One or more antenna elements 22 may be electrically coupled to the conductive lines 14. Each element 22 may be aligned perpendicular to the conductive line 14. Each element 22 may be size to resonate at a desired predetermine frequency. By providing a plurality of elements 22, the antenna assembly 10' may operate at multiple frequencies at multiple bands of operation.

Each of the elements 22 may require proper placement along the conductive line 14. Impedance issues may arise if the elements 22 are not properly positioned along the conductive line 14. There is a correlation between the location of the element 22 on the conductive line 14 and wavelength. The position and length of the elements 22 may be dependent on the dielectric material of the substrate 12, the frequency the element 22 resonates at, and the like.

The elements 22 may be positioned in a descending order from a feed point 20A of the conductive line 14 on which the element 22 is located. Thus, elements 22 resonating at a higher frequency may be positioned on the conductive line 14 closer to the feed point 20A than an element 22 resonating at a lower frequency. Thus, if multiple elements 22 are placed on the conductive line 14, the element 22 resonating at the lowest frequency may be positioned furthest from the feed point 20A, while the element resonating at the highest frequency may be positioned closest to the feed point 20A. Again, the exact location of each element 22 on the conductive line 14 may vary based on the above factors.

For example, in FIGS. 3-4, five pairs of elements 22 may be seen, wherein three pairs of elements 22 may be located along a length of the substrate 12 and may operate in a first frequency band range and two pairs of elements 22 may be located along a width of the substrate 12 and may operate in a second frequency band range. The first pair may be comprised of elements 22A and 22A', the second pair may be comprised of elements 22B and 22B', the third pair may be comprised of elements 22C and 22C', the fourth pair may be comprised of elements 22D and 22D' and the fifth pair may be comprised of elements 22E and 22E'.

The elements 22A, 22B and 22C may be positioned on the conductive line 14A while the corresponding elements 22A', 22B' and 22C' may be positioned on the conductive line 14B and resonate in the first frequency band range. In this example, the elements 22A and 22A' may resonate at a frequency of 800 MHz, the elements 22B and 22B' may resonate at a frequency of 1600 MHz and the elements 22C and 22C' may resonate at a frequency 2400 MHz. Since the elements 22A and 22A' resonate at the lowest frequency, the elements 22A and 22A' may be located furthest from the feed point 22A. If the conductive lines 14A and 14B are approximately the same length, the elements 22A and 22A' may be located approximately equal distance from the feed point 22A. The elements 22C and 22C' resonates at the highest frequency, which is approximately three times the frequency of the elements 22A and 22A', may be positioned closest to the feed point 20A. If the conductive lines 14A and 14B are approximately the same length, the elements 22B and 22B' may be located approximately equal distance from the feed point 22A. The elements 22B and 22W, which resonates at two times the frequency of the elements 22A and 22A', may be located in the middle such that element 22B may be positioned in between the elements 22A and 22C and element 22B' may be positioned in between the elements 22A' and 22C'. If the conductive lines 14A and 14B are approximately the same length, the elements 22C and 22C' may be located approximately equal distance from the feed point 22A.

The elements 22D and 22E may be positioned on the conductive line 14C while the corresponding elements 22D' and 22E' may be positioned on the conductive line 14D and resonate in the second frequency band range. In this example, the elements 22D and 22D' may resonate at a frequency of 2.4 GHz and the elements 22E and 22E' may resonate at a frequency of 3.6 GHz. Since the elements 22D and 22D' resonate at the lowest frequency, the elements 22D and 22D' may be located furthest from the feed point 22A. If the conductive lines 14C and 14D are approximately the same length, the elements 22D and 22D' may be located approximately equal distance from the feed point 22A. The elements 22E and 22E' resonates at the highest frequency, which is approximately 1.5 times the frequency of the elements 22D and 22D', may be positioned closest to the feed point 20A. If the conductive lines 14C and 14D are approximately the same length, the elements 22E and 22E' may be located approximately equal distance from the feed point 22A.

In accordance with one embodiment, the elements 22 may be planer elements instead of lumped cements. The planer elements may be microstrips 24. The microstrips 24 may be placed on substrates 26 and 30. The substrates 26 and 30 may be coupled to the substrate 12 to electrically couple the microstrips 24 to the conductive line 14 and to keep the microstrips 24 approximately orthogonal to the conductive line 14. As may be seen in FIGS. 3-4, the elements 22A, 22B and 22C may be positioned on a first side 26A of the substrate 26 and attached to the conductive line 14A while the corresponding elements 22A', 22B' and 22C' may be positioned on a second side 26B of the substrate 26 and attached to the conductive line 14B. The elements 22D and 22E may be positioned on a first side 30A of the substrate 30 and attached to the conductive line 14C while the corresponding elements 22D' and 22E' may be positioned on a second side 30B of the substrate 30 and attached to the conductive line 14D.

A cover 28 (FIG. 2) may be positioned over the elements 22 and attached to the substrate 12. The cover 28 may be used to prevent damage to the elements 22.

The foregoing description is illustrative of particular embodiments of the application, but is not meant to be a limitation upon the practice thereof. The following claims, including all equivalents thereof, are intended to define the scope of the application.

What is claimed is:

1. An antenna assembly comprising:

a first substrate;

an opening formed in a central area of the first substrate;

a first conductive line formed on a first surface of the first substrate and running down a length of the first substrate;

a first transmission line positioned through the opening and electrically coupled to the first conductive line; and a first plurality of pairs of elements, each pair of the first plurality of elements resonating at different predetermined frequencies in a first frequency bandwidth, each of the first plurality of pairs of elements having a first member and a corresponding member, wherein each of the first plurality of pairs of elements is electrically coupled to the first conductive line and aligned perpendicular to the first conductive line, wherein the first member of each the first plurality of pairs of elements positioned on a first side of the feed point along the length of the first substrate and the corresponding member of each of the first plurality of pairs of elements positioned on an opposing side of the feed point along the length of the first substrate, the different predetermined frequencies determining a distance from the feed point along the first conductive line for each of the first plurality of pairs elements;

wherein each pair of elements of the first plurality of pairs of elements is positioned in descending order with a highest frequency pair of elements of the first plurality of pairs of elements located closest to the feed point and a lowest frequency pair of elements of the first plurality of pairs of elements located furthest from the feed point;

wherein the highest frequency pair of elements of the first plurality of pairs of elements operates at 2400 MegaHertz (MHz);

wherein a second highest frequency pair of elements of the first plurality of pairs of elements operates at 1600 MHz;

wherein the lowest frequency pair of elements of the first plurality of pairs of elements operates at 800 MHz;

a second conductive line formed on the first surface of the substrate and running down a width of the first substrate; a second transmission line positioned through the opening and electrically coupled to the second conductive line; and a second plurality of pairs of elements, each pair of the second plurality of elements resonating at different predetermined frequencies in a second frequency bandwidth, each of the second plurality of pairs of elements having a first member and a corresponding member, wherein each of the second plurality of pairs of elements is electrically coupled to the second conductive line and aligned perpendicular to the second conductive line, wherein the first member of each the second plurality of pairs of elements positioned on a first side of the feed point along the width of the substrate and the corresponding member of each of the second plurality of pairs of elements positioned on an opposing side of the feed point along the width of the substrate, the different predetermined frequencies determining a distance from the feed point along the second conductive line for each of the second plurality of pairs elements.

2. The antenna assembly in accordance with claim 1, comprising a third substrate positioned perpendicular to the first substrate, the second plurality of pairs of elements attached to the third substrate.

3. The antenna assembly in accordance with claim 1, comprising a third substrate positioned perpendicular to the first substrate, wherein the first member of each of the second plurality of pairs of elements is positioned on a first side of the third substrate and the corresponding member of each of the second plurality of pairs of elements is positioned on an opposing side of the third substrate.

4. An antenna assembly comprising:

a first substrate;

an opening formed in a central area of the first substrate;

a first of conductive line formed on a first surface of the first substrate and running down a length of the first substrate;

a first transmission line positioned through the opening and electrically coupled to the first conductive line;

a first plurality of pairs of elements, each pair of the first plurality of elements resonating at different predetermined frequencies in a first frequency bandwidth, each of the first plurality of pairs of elements having a first member and a corresponding member, wherein each of the first plurality of pairs of elements is electrically coupled to the first conductive line and aligned perpendicular to the first conductive line, wherein the first member of each the first plurality of pairs of elements positioned on a first side of the feed point along the length of the first substrate and the corresponding member of each of the first plurality of pairs of elements positioned on an opposing side of the feed point along the length of the first substrate, the different predetermined frequencies determining a distance from the feed point along the first conductive line for each of the first plurality of pairs elements; and a second substrate positioned perpendicular to the first substrate and running down the length of the first substrate, the first plurality of pairs of elements attached to the second substrate;

wherein each pair of elements of the first plurality of pairs of elements is positioned in descending order with a highest frequency pair of elements of the first plurality of pairs of elements located closest to the feed point and a lowest frequency pair of elements of the first plurality of pairs of elements located furthest from the feed point;

wherein the highest frequency pair of elements of the first plurality of pairs of elements operates at 2400 MegaHertz (MHz);

wherein a second highest frequency pair of elements of the first plurality of pairs of elements operates at 1600 MHz;

wherein the lowest frequency pair of elements of the first plurality of pairs of elements operates at 800 MHz.

5. The antenna assembly in accordance with claim 4, wherein the first member of each of the first plurality of pairs of elements is positioned on a first side of the second substrate and the corresponding member of each of the first plurality of pairs of elements is positioned on an opposing side of the second substrate.

6. The antenna assembly in accordance with claim 4, comprising: a second conductive line formed on the first surface of the first substrate and running down a width of the first substrate, the second conductive line electrically coupled to the transmission line; a second transmission line positioned through the opening and electrically coupled to the second conductive line; and a second plurality of pairs of elements, each pair of the second plurality of elements resonating at different predetermined frequencies in a second frequency bandwidth, each of the second plurality of pairs of elements having a first member and a corresponding member, wherein each of the second plurality of pairs of elements is electrically coupled to the second conductive line and aligned perpendicular to the second conductive line, wherein the first member of each of the second plurality of pairs of elements is positioned on a first side of the feed point along the width of the first substrate and the corresponding member of each of the second plurality of pairs of elements is positioned on an opposing side of the feed point along the width of the first substrate, the different predetermined frequencies determining a distance from the feed point along the second conductive line for each of the second plurality of pairs elements.

7. The antenna assembly in accordance with claim 6, comprising a third substrate positioned perpendicular to the first substrate and the second substrate, the second plurality of pairs of elements attached to the third substrate.

8. The antenna assembly in accordance with claim 6, comprising a third substrate positioned perpendicular to the first substrate and the second substrate, wherein the first member of each of the second plurality of pairs of elements is positioned on a first side of the third substrate and the corresponding member of each of the second plurality of pairs of elements is positioned on an opposing side of the third substrate.

9. The antenna assembly in accordance with claim 6, wherein the first conductive line, the second conductive line, the first plurality of pairs of elements and the second plurality of pairs of elements are formed of microstrips.

* * * * *